United States Patent [19]

Geyser et al.

[11] Patent Number: 4,897,980

[45] Date of Patent: Feb. 6, 1990

[54] APPARATUS FOR FORMING A BULK PACKAGE

[75] Inventors: Joseph E. Geyser, Brentwood; Nestor Kozbur, Antioch, both of Calif.

[73] Assignee: James River Corporation, Oakland, Calif.

[21] Appl. No.: 360,484

[22] Filed: Jun. 5, 1989

[51] Int. Cl.[4] ..... B65B 11/00; B65B 35/50; B65B 61/20

[52] U.S. Cl. ..... 53/128; 53/397; 53/447; 53/540; 53/580

[58] Field of Search ..... 53/128, 222, 284, 287, 53/397, 535, 537, 540, 564, 580, 447; 206/595, 597, 598

[56] References Cited

U.S. PATENT DOCUMENTS

| | | | |
|---|---|---|---|
| 2,277,674 | 3/1942 | Belsinger | 206/586 X |
| 3,007,293 | 11/1961 | McGihon | 53/580 X |
| 3,378,987 | 4/1968 | Lems | 53/128 X |
| 3,626,660 | 12/1971 | Dorfmann | 53/287 X |
| 3,805,473 | 4/1974 | Lidgard | 53/397 |
| 4,244,471 | 1/1981 | Plante | 206/586 |
| 4,483,444 | 11/1984 | Gardner | 206/597 X |
| 4,587,791 | 5/1986 | Brouse et al. | 53/128 |
| 4,610,125 | 9/1986 | Meives et al. | 53/564 X |

FOREIGN PATENT DOCUMENTS

| | | | |
|---|---|---|---|
| 2431153 | 1/1976 | Fed. Rep. of Germany | 53/128 |

*Primary Examiner*—John Sipos
*Assistant Examiner*—Beth Bianca
*Attorney, Agent, or Firm*—Thomas R. Lampe

[57] ABSTRACT

Apparatus for forming a bulk package and including bottom tray placement means for placing a bottom tray on a support, stacking means for stacking layers of objects on the bottom tray, top cap positioning means for positioning a top cap over the upper-most layer of stacked objects, and post member positioning means for positioning post members at preselected spaced locations between the bottom tray and top cap.

20 Claims, 7 Drawing Sheets

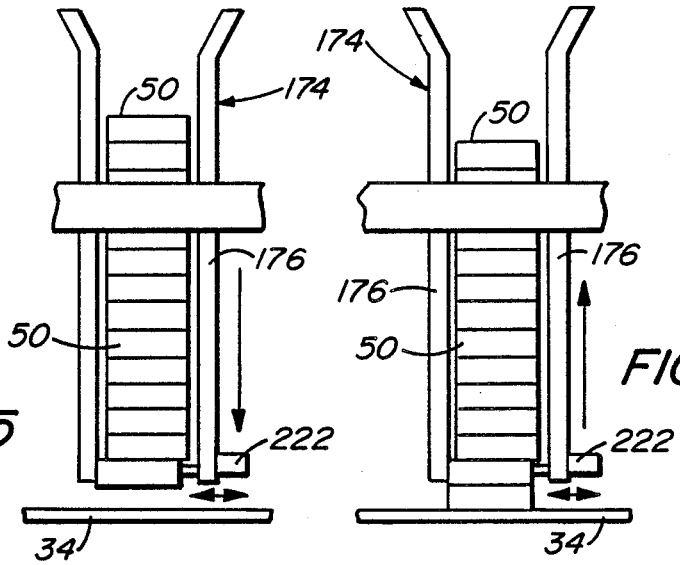
FIG._5
FIG._5A
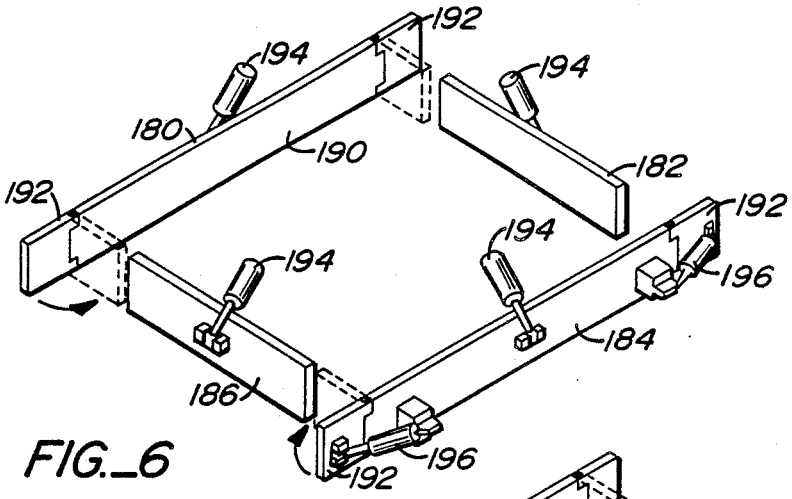
FIG._6
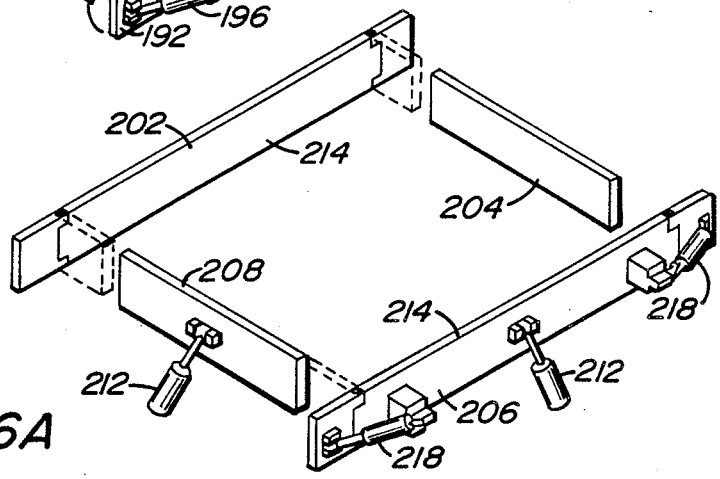
FIG._6A

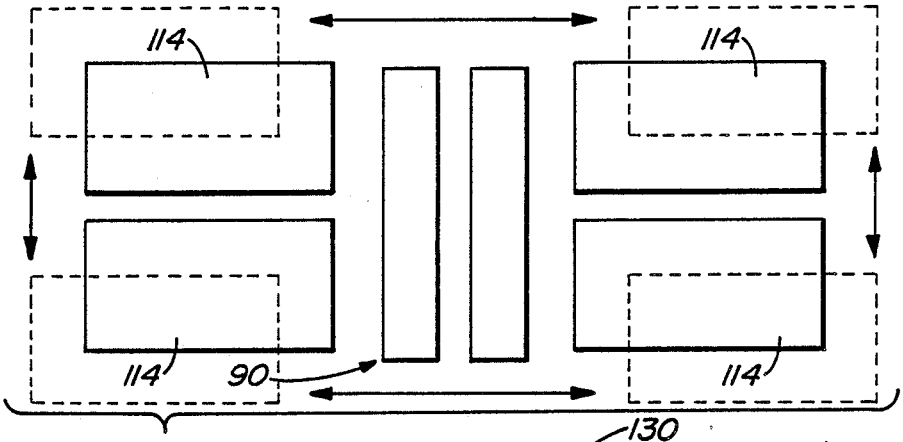
FIG._7
FIG._8
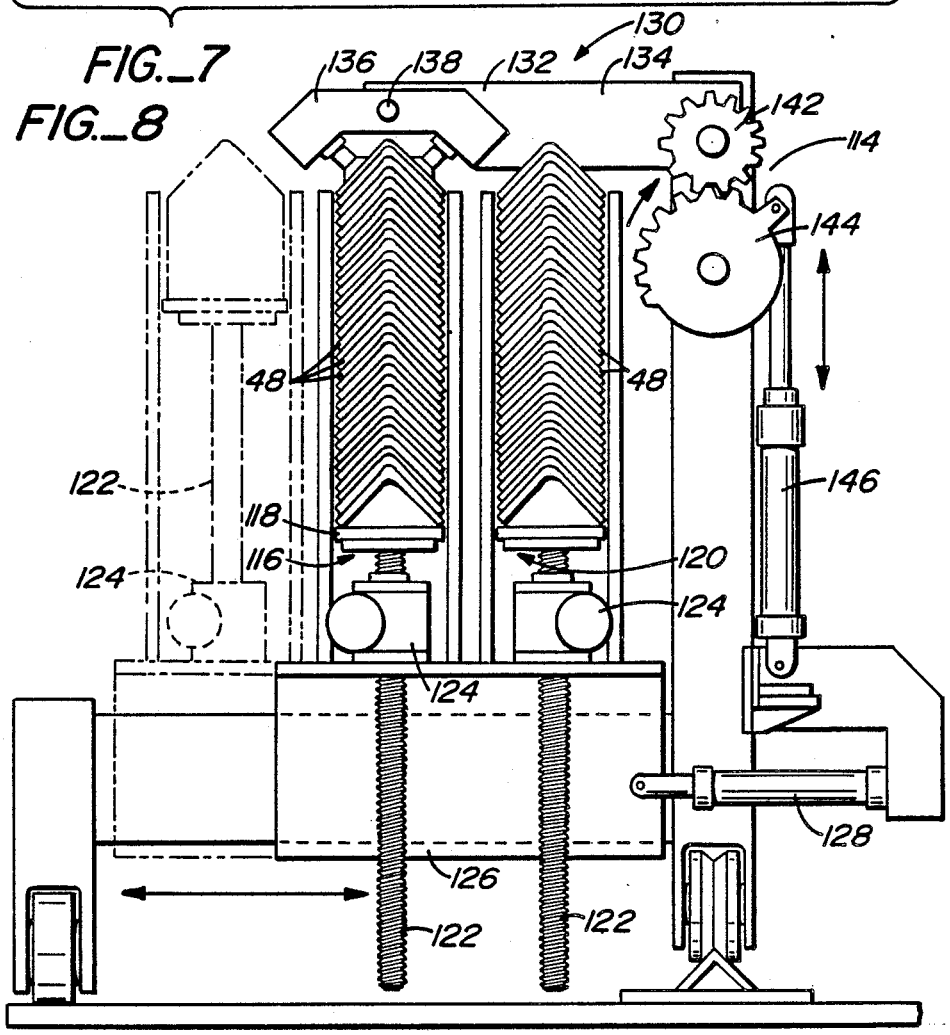

APPARATUS FOR FORMING A BULK PACKAGE

TECHNICAL FIELD

The present invention relates to an apparatus for forming a bulk package. More specifically, the apparatus is adapted to form a bulk package including objects, such as individual packages, stacked in layers with each layer comprising a plurality of the objects disposed in rows. The bulk package also includes a bottom tray disposed under the lower-most layer, a top cap disposed over the upper-most layer and a plurality of elongated post members extending between the bottom tray and the top cap.

BACKGROUND ART

It is known in the prior art to form bulk packages of objects stacked in layers. In particular, it is known to form multi-tiered or multi-layered bulk packages of individual packages whereby the individual packages may be shipped and stored in bulk prior to separate sale thereof to a customer.

Obviously it is advantageous to hold costs of bulk packaging to a minimum while providing a bulk package which has the requisite strength requirements. Such considerations become especially significant when the individual objects to be bulk packaged for shipment and storage are themselves relatively inexpensive. Examples of this latter type of object are individual wrapped packages of one or more roll paper products. It is also desirable to minimize the weight of the bulk package itself to hold down transport costs.

A number of bulk package arrangements have been devised for transporting and storing a large number of individual packages of roll paper products such as paper towels and toilet tissue. One such bulk package found to be particularly suitable for products of this nature is a bulk package employing a bottom tray disposed under the lower-most layer of a plurality of layers of individual packages, a top cap disposed over the upper-most layer, and a plurality of elongated post members extending between the bottom tray and the top cap. This entire assembly is conventionally over-wrapped with plastic film for subsequent shipping and storage.

It has been conventional practice up to the present to manually construct a bulk package of the type just described. Obviously, such a procedure is labor intensive and expensive.

It is therefore an object of the present invention to provide an apparatus for forming a bulk package of the afore-described type. The preferred form of apparatus disclosed herein is specifically adapted to form a bulk package including a plurality of individual packages of roll towels or the like. Not only does the apparatus efficiently and quickly form such a bulk package, it is capable of forming bulk packages of different sizes and from different sized individual packages.

DISCLOSURE OF INVENTION

Apparatus constructed in accordance with the teachings of the present invention performs a variety of operations culminating in the formation of a bulk package including objects, such as roll paper towel packages, stacked in layers with each layer comprising a plurality of objects disposed in rows.

The apparatus includes bottom tray placement means for placing a bottom tray on a support. Stacking means is then employed for stacking the layers of objects on the bottom tray.

After the objects have been stacked to a desired height, top cap positioning means positions a top cap over the upper-most layer of objects. Post member positioning means is then utilized to position post members at preselected spaced locations between the bottom tray and the top cap.

In the particular embodiment of the invention disclosed herein, the bottom tray and top cap each include a central panel and flaps disposed at least partially about the periphery thereof, and the apparatus additionally comprises flap manipulating means for engaging the cap and tray flaps, folding them relative to the panels, and bringing the flaps into engagement with the post members. The tray flaps and cap flaps are secured together by adhesive and serve to maintain the post members at the preselected spaced locations.

Other features, advantages and objects of the present invention will become apparent with reference to the following detailed description and accompanying drawings.

BRIEF DESCRIPTION OF DRAWINGS

FIGS. 5, 5A are diagrammatic side views of a preselected portion of spacer pad applicator means during subsequent stages of the operation thereof when applying a spacer pad to the bulk package top cap;

FIG. 6 is a diagrammatic perspective view of cap flap manipulating means,

FIG. 6A is a diagrammatic perspective view of tray flap manipulating means;

FIG. 7 is a schematic presentation illustrating an apparatus adjustability feature; and FIG. 8 is a diagrammatic side view of selected components of the apparatus post member placement mechanism.

BEST MODE FOR CARRYING OUT THE INVENTION

Figure 1:
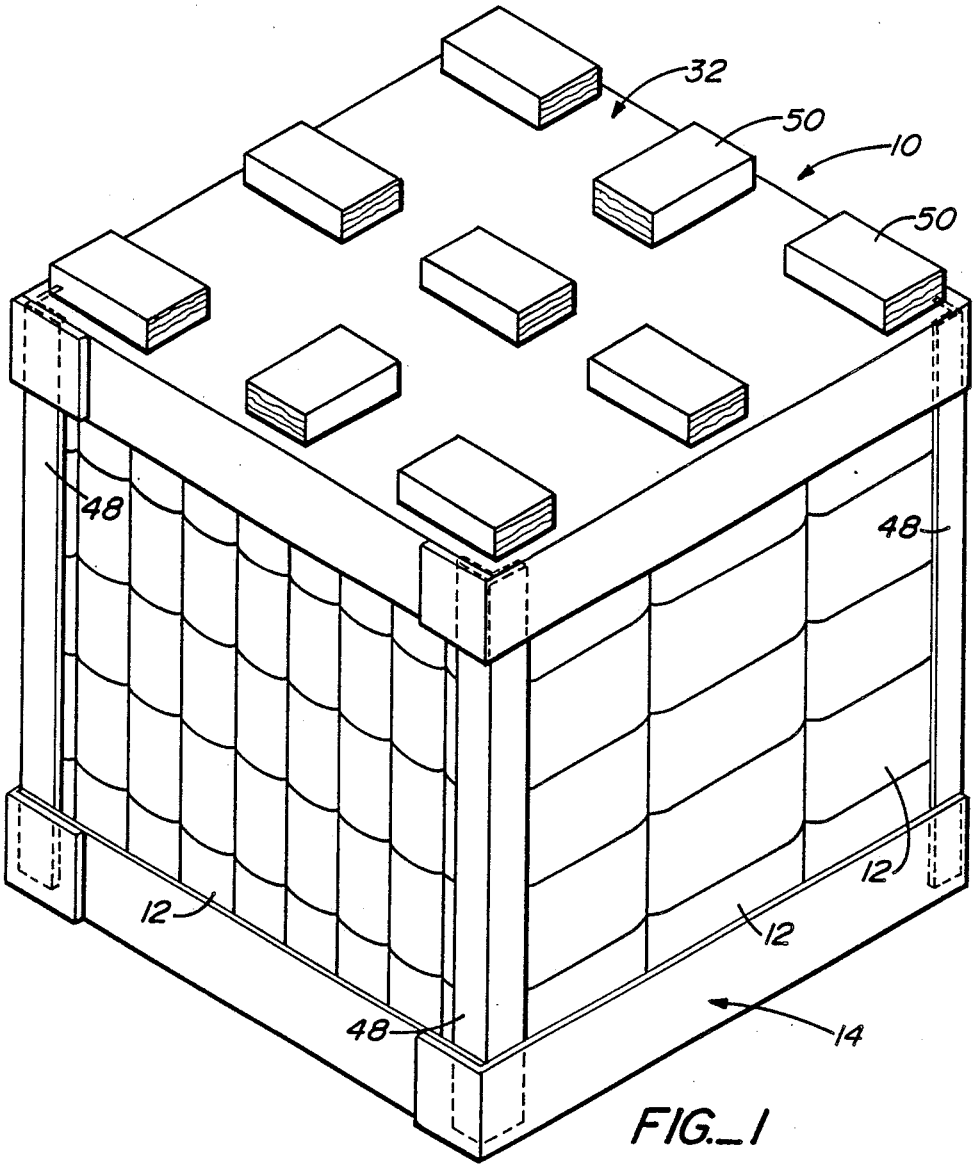
FIG. 1 is a perspective view of a bulk package assembled by apparatus constructed in accordance with the teachings of the present invention.

Referring now to FIG. 1, a bulk package of the type formed by the apparatus of the present invention is illustrated. The bulk package is designated generally by reference numeral 10 and includes objects 12 stacked in layers with each layer comprising a plurality of the objects disposed in rows. In FIG. 1 the objects 12 are individual packages, each of which contains a plurality of paper towels. For example, each package 12 might accommodate anywhere from three rolls to twelve rolls of toweling or more. In the bulk package configuration illustrated, the individual packages 12 are disposed in nine rows in one direction and three rows in another direction. As will be seen below, the apparatus of the present invention incorporates an adjustability feature which enables the apparatus to be adjusted to handle a variety of individual package sizes and configurations.

Figure 2:
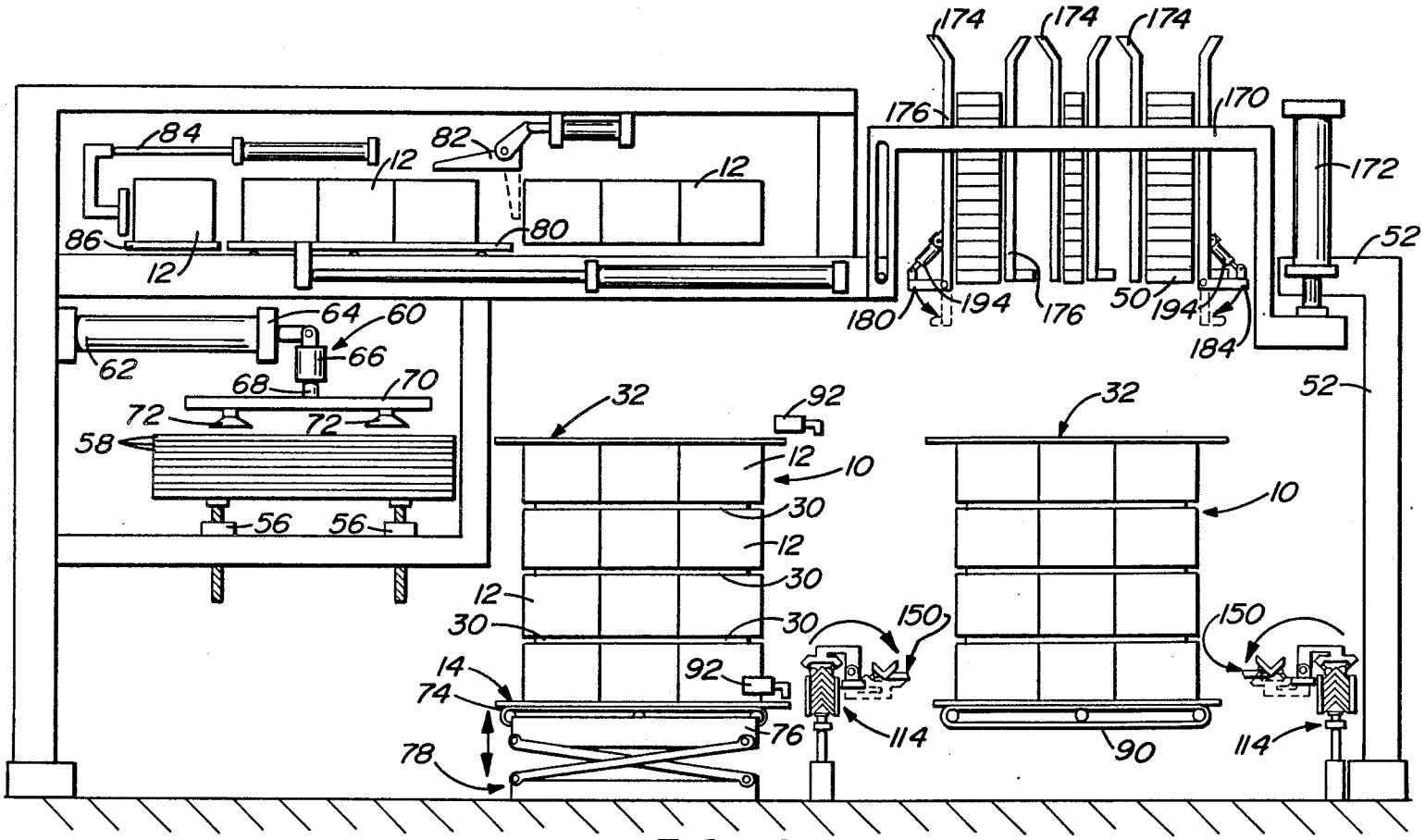
FIG. 2 is a diagrammatic side view of a preferred embodiment of apparatus constructed in accordance with the teachings of the present invention.

Referring now also to FIG. 2, the bulk package 10 also includes a bottom tray 14 including a central tray panel 16 and tray flaps 18, 20, 22, and 24. Opposed tray flaps 20, 24 each include a central tray flap portion 26 and end tray flap portions 28 hingedly connected to opposed ends of the central trap flap portion 26.

In the completed bulk package 10 bottom tray 14 is disposed under the lower-most layer of packages 12. It will be appreciated that the outer periphery of the stacked packages 12 corresponds generally to the shape of the tray panel 16. In the embodiment shown in FIG. 1, there are five layers of individual packages 12. As will be seen below, however, the apparatus of the present invention is adapted to form bulk packages of various layer heights.

Disposed between each of the layers is a tier sheet 30 of paperboard or the like which has an outer periphery generally conforming in shape to that of tray panel 16. A top cap 32 is disposed over the upper-most layer of individual packages or objects 12. The top cap 32 is also suitably constructed of corrugated paperboard or the like, as is the previously described bottom tray 14.

Top cap 32 includes a central cap panel 34 and cap flaps 36, 38, 40, and 42 disposed at least partially about the periphery of the cap panel. Opposed cap flaps 38, 40 each includes a central cap flap portion 44 and end cap flap portions 46 hingedly connected to opposed ends of the central cap flap portion. Thus, it is readily apparent that the bottom tray 14 and top cap 32 are identical in construction. This is advantageous since only one blank style need be utilized to function as either the bottom tray or top cap.

In the assembled bulk package 10, the tray flaps of bottom tray 14 and the cap flaps of the top cap 32 are folded and disposed at 90 degree angles with respect to the bottom tray and cap flap. As will be described in greater detail below, the cap flaps are secured together by adhesive to maintain the configuration illustrated in FIG. 1. Similarly, the tray flaps are secured together by adhesive to maintain their respective positions shown in FIG. 1.

Yet another component of the bulk package 10 is a plurality of elongated post members 48 extending between the bottom tray and the top cap. As can clearly be seen, the post members each have a generally V-shaped cross-section. The post members are preferably constructed of a relatively rigid, strong, yet inexpensive, material such as fiberboard. In the assembled bulk package 10 the post members are located at the bulk package corners with the open end of the V-shape oriented toward the individual packages 12. The tray flaps and the cap flaps are in engagement with the post members. Thus, the upper ends of the post members are frictionally engaged and maintained in position by the packages 12 located at the corners and the cap flaps. Similarly, the lower ends of the post members are frictionally engaged and maintained in position by the packages 12 located at the corners and the tray flaps.

Yet another component of the bulk package 10 is a plurality of spacer pads 50 which are secured to the top of top cap panel 34 by adhesive. Each spacer pad ma be constructed of any suitable material such as multi-laminate, corrugated paperboard. The spacer pads are essentially block-shaped and have sufficient height and clearance therebetween to allow for fork lift passage. Such an arrangement will enable bulk packages 10 to be stacked one upon the another for storage and shipment.

The apparatus for forming the bulk package 10 will now be described. Referring now specifically to FIG. 2, the apparatus for forming the bulk package includes a framework 52. Disposed on framework 52 are a plurality of jack screws 56 which serve to support a stack of blanks 58 which ar all of identical construction and can be used interchangeably as either bottom trays 14 or top caps 32. As stated above, the bottom tray and top cap of the bulk package 10 shown in FIGS. 1 and 2 are of identical construction.

Disposed above the stack of blanks 58 is blank placement mechanism 60 which includes a pneumatic cylinder 62 and an arm 64 fixably attached to and movable with a piston within cylinder 62 in a conventional manner. Dependent from the free end of arm 64 is a second pneumatic cylinder 66 having a piston arm 68 movably relative thereto. It will be appreciated that arm 64 is reciprocatably movable in a horizontal plane while arm 68 is reciprocatably movable in a vertical plane, as viewed in FIG. 2.

Connected to the distal end of piston arm 68 is a vacuum cup support 70 having a plurality of vacuum cups 72 dependent therefrom. The blank placement mechanism 60 just described functions to move blanks 58 seriatim from the stack of blanks, transport the removed blank to the right, as viewed in FIG. 2, and place the removed blank over a support in the form of an endless belt conveyer 74. That is, the vacuum cup support 70 is moved down from the position illustrated in FIG. 2 until the vacuum cups 72 contact the upper-most of blanks 58. At this stage, vacuum is formed at the cups and the vacuum cups retain the top-most blank when the support 70 is retracted upwardly. The pneumatic cylinder 62 and arm 64 then cooperate to move the suspended blank to the right as viewed in FIG. 2 until the blank is disposed over the conveyer 74.

The jack screws 56 are preferably of the commercially available type which will automatically raise the rest of the stack of blanks upwardly a distance corresponding to a single blank thickness when a blank has been removed. Blank placement mechanisms and jack screw devices are well known per se in the prior art; thus, it is not deemed necessary to describe these in great detail.

In FIG. 2, the belt conveyer 74 is mounted on a frame 76 which comprises the upper portion of a scissors lift or elevator 78 which is illustrated diagrammatically and may be of any suitable conventional construction. The scissors lift 78, when actuated, will result in either upward or downward movement of frame 76 and hence conveyer 74 as shown by the double headed arrow disposed adjacent to the depiction of the scissors lift 78.

FIG. 2 shows a partially assembled bulk package 10 disposed upon the support provided by the belt conveyer 74, such partially completed bulk package including a bottom tray 14, paper towel packages 12 stacked in layers (four layers in the illustrated configuration), and a top cap 32.

Formation of the bulk package commences with placement of the bottom tray 14 on belt conveyer 74 by blank placement mechanism 60. This occurs with the scissors lift 78 in partially extended position, that is, with the upper run of belt conveyer 74 disposed at about the same location top cap 32 occupies in FIG. 2. After the bottom tray 14 is positioned on the belt conveyer 74, the scissors lift 78 extends even further so that the bottom tray 14 is disposed adjacent to and generally in line with individual package conveyer 80 which may be of any suitable construction. Package conveyer 80 is part of a mechanism adapted to assemble a layer of paper towel packages 12. Devices of this nature are well known in the art and will not be described in detail. Suffice it to say that individual package conveyer 80 is in the form of a shuttle plate which moves from its position illustrated in FIG. 2 to the right, as viewed in that figure, to a location above scissors lift 78.

When the shuttle plate moves back to its illustrated position, a hydraulically operated stop member 82 moves from the illustrated solid line position to the dash line position shown in FIG. 2 to prevent the paper towel packages 12 from returning also. In other words, the paper towel packages 12 are retained in fixed position to the right of stop member 82 while the conveyer or shuttle plate 80 moves back to the left and is withdrawn from underneath the packages 12. A pusher device 84, which is preferably pneumatically actuated, cooperates with a feed conveyer 86 to again form a layer of paper towel packages 12 on shuttle plate 80 Mechanisms of this general type are also well known in the packaging art and any suitable arrangement may be provided to assemble a desired number of paper towel packages 12 in any desired configuration or "footprint" upon the shuttle plate 80.

It will be appreciated that when shuttle plate 80 retracts to the left as viewed in FIG. 2, the first layer of paper towel packages 12 will be disposed on tray panel 16 of bottom tray 14. After this has been accomplished, the scissors lift 78 will retract a distance generally corresponding to the height of a paper towel package 12. The just described cycle continues until a desired number of individual package layers are stacked on the bottom tray.

Figure 4:
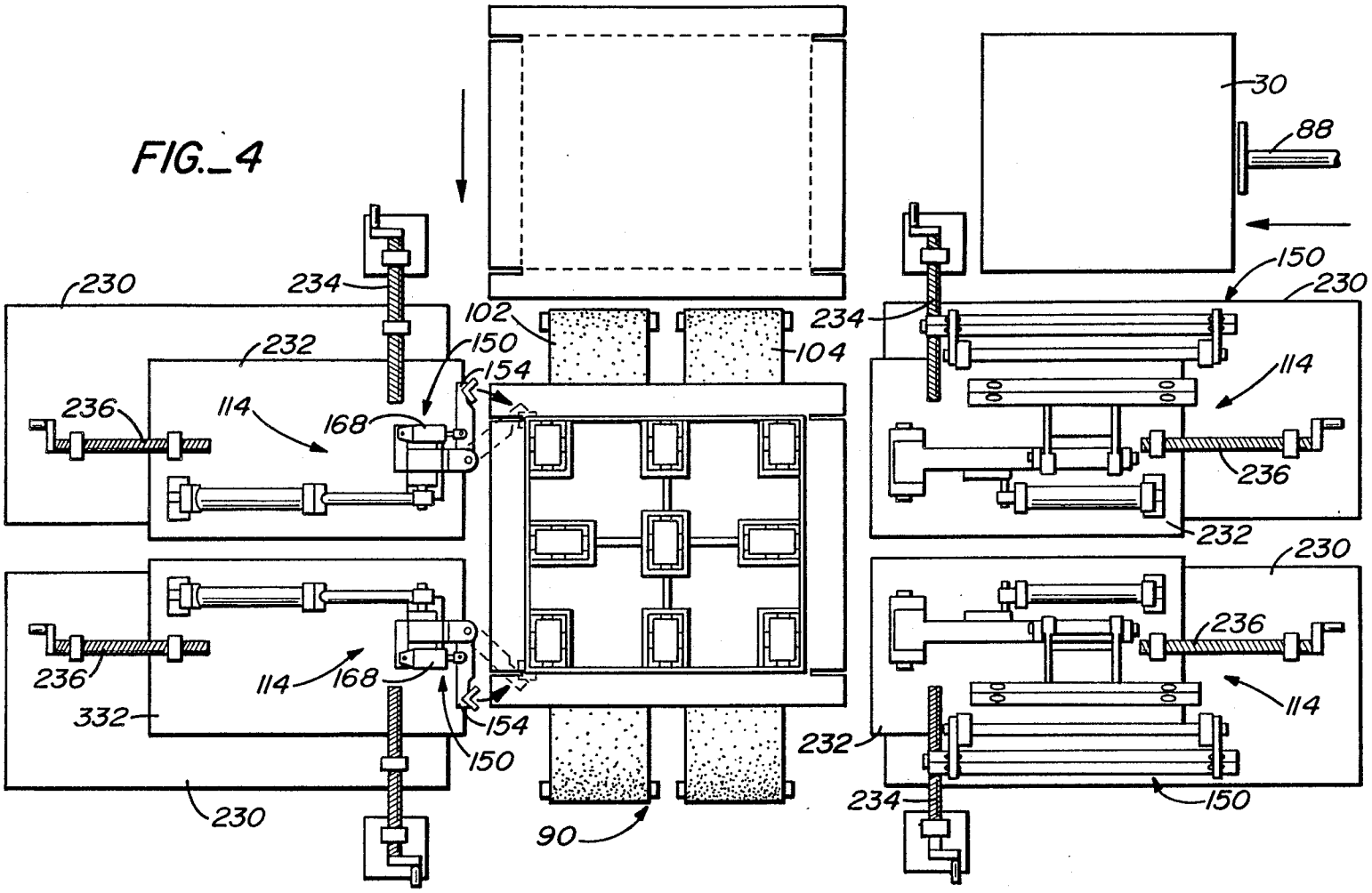
FIG. 4 is a diagrammatic plan view illustrating selected components of the apparatus.

It is preferable that tier sheets 30 be positioned between each layer of packages 12 to provide bulk package stability and strength. Any suitable device may be utilized to place the tier sheets on a layer prior to placement of a subsequent individual package layer. For example, the tier sheets may be positioned in place by a mechanism similar to blank placement mechanism 60. FIG. 4 provides a schematic illustration of a tier sheet 30 being transported by a pusher arm 88 which is part of an overall tier sheet placement mechanism, the remainder of which, in the interest of simplicity, has not been illustrated.

After the upper-most layer of paper towel packages has been stacked, the scissors lift 78 retracts to the position shown in FIG. 2. The blank placement mechanism 60 then operates to position the top cap 32 over the upper-most layer of packages 12 precisely in the manner it functioned during placement of the bottom tray 14.

At this stage of the operation the bottom tray 14 and top cap 32 have a generally planar configuration; that is, the tray flaps of the bottom tray are in alignment with the tray panel and the cap flaps of the top cap are in alignment with the cap panel. The tray flaps and cap flaps therefore project beyond the stack of paper towel packages 12.

The next step of the operation of the apparatus is to transport the partially assembled bulk package 10 to the right as viewed in FIG. 2. This is accomplished by actuating belt conveyer 74 so that the upper run thereof moves toward the right. Substantially simultaneously therewith a second belt conveyer 90 is actuated so that its belt rotates in a clockwise direction a viewed in FIG. 2. An intermediate belt conveyer (not shown) can be disposed between belt conveyers 74 and 90 to insure that there is a smooth transition therebetween of the partially assembled bulk package 10. Such intermediate conveyer has not been illustrated in the interest of simplicity and, in fact, may not be necessary if belt conveyers 74 and 90 are close enough to prevent tipping or other undue movement of the bulk package 10 as it is being conveyed.

Figure 1A:
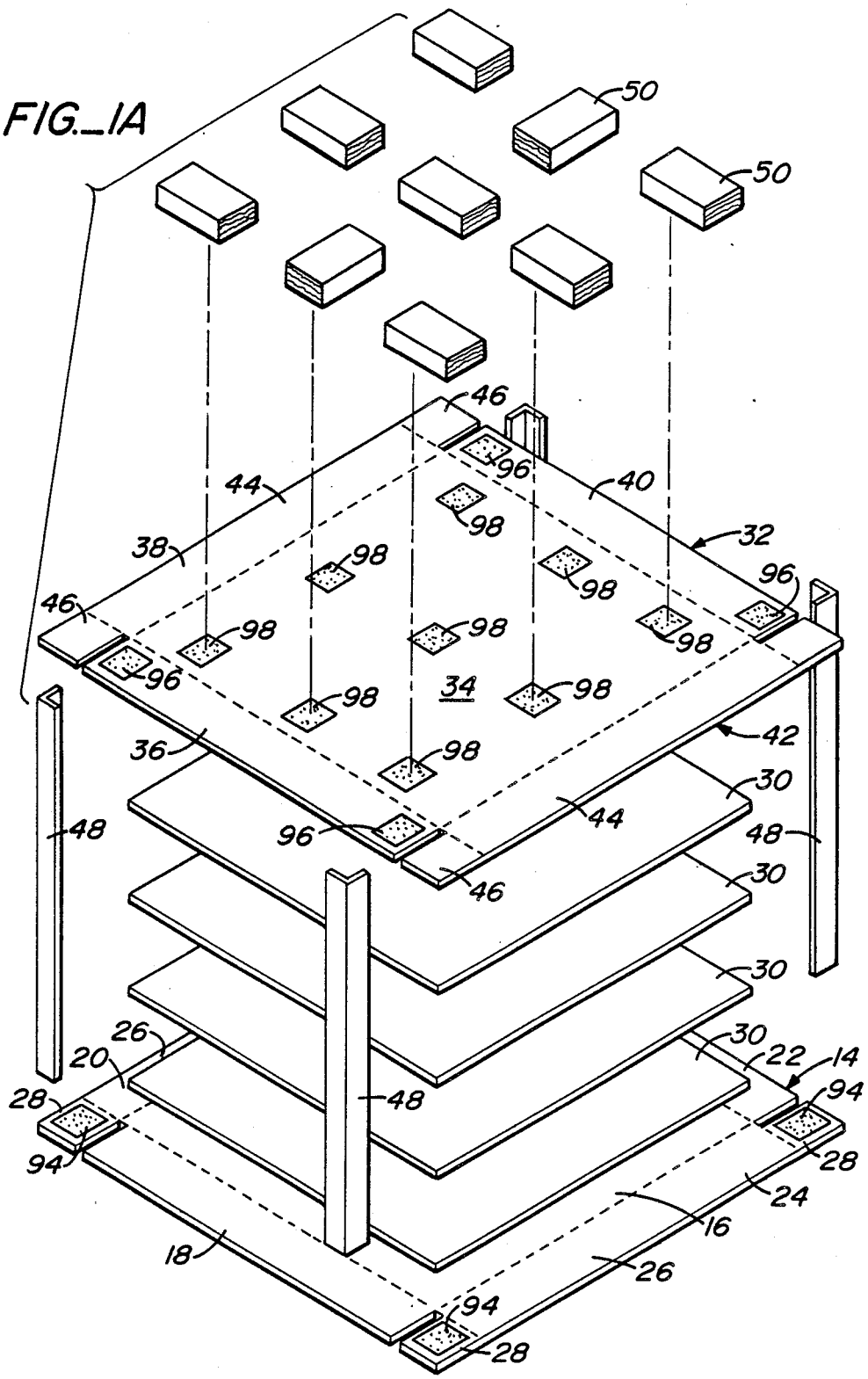
FIG. 1A is an exploded perspective view of the elements of the bulk package of FIG. 1 exclusive of the individual packages.
Figure 3:
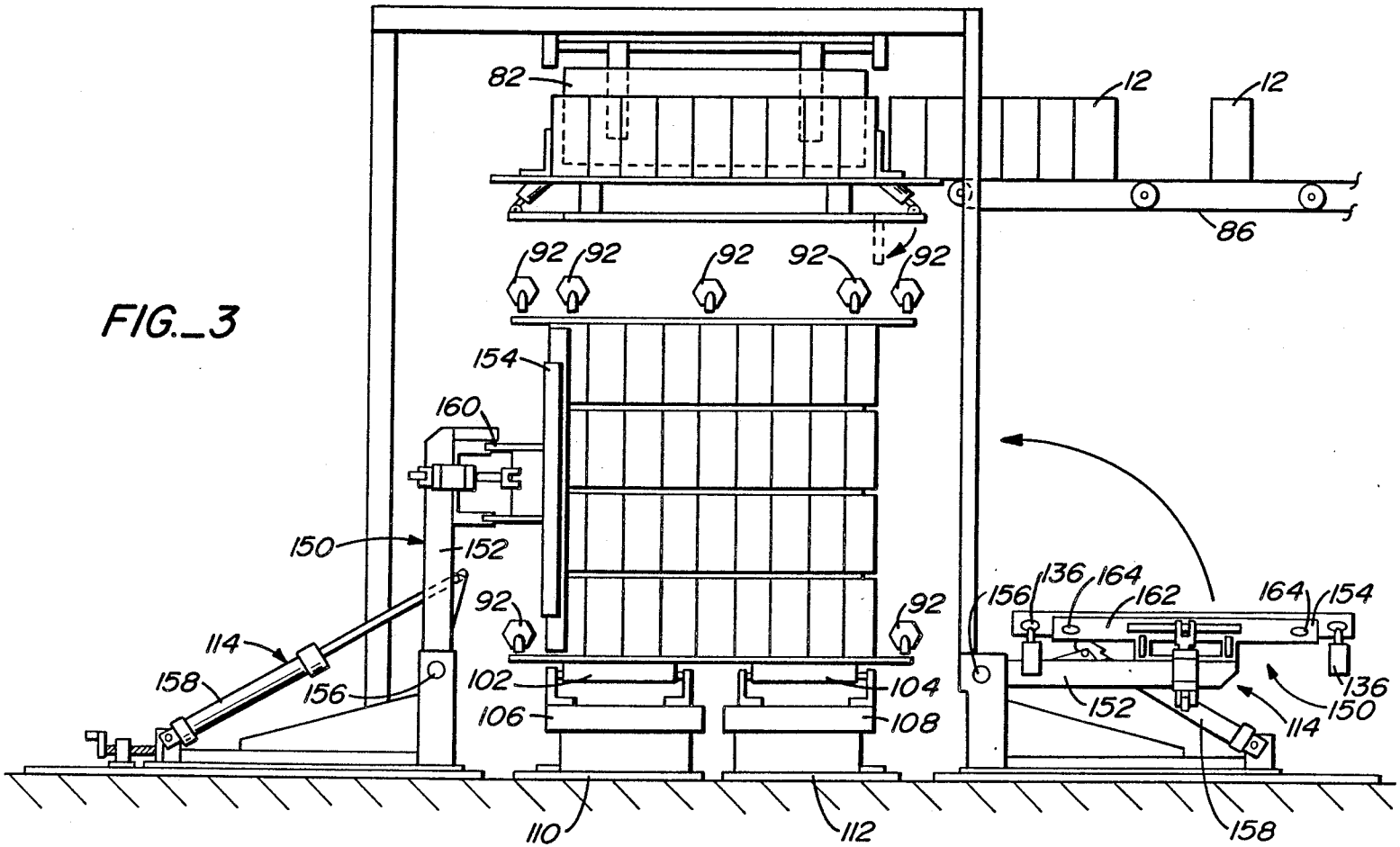
FIG. 3 is a diagrammatic end view of the apparatus and illustrating selected components thereof.

As perhaps best seen with reference to FIGS. 2 and 3, the partially assembled bulk package 10 during conveyance thereof between belt conveyer 74 and belt conveyer 90 passes by a plurality of spray nozzles 92 which are adapted to spray adhesive onto the bottom tray 14 and top cap 32. More particularly, the spray nozzles 92 are disposed in two tiers, with some of the nozzles applying adhesive to predetermined portions 94 (see FIG. 1A) of the tray flaps and cap flap predetermined portions 96. In addition, some of the spray nozzles 92 are adapted to apply adhesive to the cap panel 34 at predetermined areas 98 thereof. Preferably, the spray nozzles 92 are mounted in such a manner as to be readily adjustable whereby the spray nozzles can be moved to adapt to bulk packages 10 of different dimensions, as for example, when the bulk package is formed from individual packages or objects 12 of different dimension or number. All nozzles are pointed downwardly to render adhesive application more effective. Any suitable control mechanism such as a well-known photo eye and switch arrangement may be employed to actuate and deactuate the spray nozzles.

As may be seen in FIGS. 3 and 4, belt conveyer 90 comprises two-spaced belts 102, 104 which are separately journaled on rollers supported by two independent conveyer frames 106, 108. Preferably, each of these conveyer frames is adjustable whereby they may be moved toward or away from one another on mounting pads 110, 112. A track and roller arrangement (not shown) may be utilized to facilitate relative adjustment of the conveyer frames.

When the partially assembled bulk package 10 arrives at the position shown at the right of FIG. 2, the conveyer 90 stops. For example, the conveyer may be associated with an electric eye (not shown) which senses the arrival of the partially assembled bulk package at the desired location. The partially assembled bulk package 10 is now in position to have a variety of operations performed thereon to complete assembly thereof.

In the right hand position illustrated in FIG. 2, the partially assembled bulk package 10 is located between 4 post member positioning devices 114. The post member positioning devices are of identical construction and each is operatively associated with a corner of the bulk package formed by intersecting sides thereof. The post member positioning devices 114 each include magazine structure 116 adapted to hold a plurality of post members. One such magazine structure 116 is illustrated in FIG. 8. Each magazine structure includes two separate open-topped holders 118, 120 disposed side by side, with each holder having side walls and a bottom wall upon which is stacked a plurality of post members 48. Each holder is attached to a threaded element 122 selectively movable in an up-and-down fashion by an associated electrical jack screw motor 124 mounted on mounting member 126. Mounting member 126 is selectively movable between the solid line position shown in FIG. 8 to the phantom line position illustrated therein by a prime mover which may, for example, be a hydraulic cylinder 128.

It will be appreciated that the jack screw motors 124 are operatively associated with any suitable conventional control means to automatically raise a stack of post members 48 the thickness of a post member each time a top-most post member is removed from the stack in a manner which will be described below. The phantom line representation presented in FIG. 8 shows a partially depleted stack and in such condition the motor 124 has caused its associated threaded element 122 to move upwardly along with the holder bottom support wall past the holder side walls which are fixed in position by any known expedient.

The post member positioning device 114 also includes means for removing a post member from the aforedescribed magazine structure. This post member removal means is generally designated by reference numeral 130 and includes a pick-up element 132 movable between a first position whereat the pick-up element engages the post member at the magazine structure (the position illustrated in FIG. 8) to a second position spaced from the magazine structure. The pick-up element 132 comprises a pair of spaced, pivoted pick-up arms 134 and a vacuum cup assembly 136 pivotally mounted on each pick-up arm 134 on a pivot 138.

Each vacuum cup assembly includes a plurality of vacuum cups 140 which are angled as perhaps best seen in FIG. 8 so that the cups engage the diverging legs of the generally V-shaped post members. The pivot connection 138 between vacuum cup assemblies 136 and pick-up arms 134 facilitates relative positioning of the vacuum cups 140 to accommodate any change in positioning or configuration of the post members at the top of a stack. The vacuum cups 140 are operatively associated with any suitable vacuum source through any suitable arrangement whereby a vacuum may be selectively applied to the top-most engaged post member and cause same to adhere to the vacuum cups.

As can perhaps best be seen with reference to FIG. 8, the end of pick-up arms 134 remote from vacuum cup assemblies 136 is operatively associated with a gear 142 having teeth engaging teeth of a rotatable drive member 144. Member 144 is rotated in a reciprocal manner by a prime mover which may, for example, be a hydraulic cylinder 146. Extension of the arm of the hydraulic cylinder 136 will cause counter clock-wise pivoting of pick-up arms 134. Retraction of the hydraulic cylinder device will cause the pick-up arms to rotate in clockwise fashion about the end thereof remote from vacuum cup assemblies 136.

When the pick-up arms 134 are rotated clock-wise as illustrated by the arrow in FIG. 8, the vacuum cups 140, having had vacuum applied thereto, serve to lift from the stack of post members disposed therebelow the top-most post member which of course is engaged at spaced locations thereon by the vacuum cups.

The pick-up element 132 moves about a fixed pivot and the holders 118, 120 may be selectively positioned under the vacuum cup assemblies 136 merely by actuating prime mover 128. If desired, the holders 118, 120 may contain post members 48 of the same length. Alternatively, where different-sized bulk packages are being formed, post members of different lengths may be held in each of the holders with the prime move 128 operating to bring the proper holder into registry with the vacuum cup assemblies 136 depending upon how many tiers or layers of paper towel packages or other objects are to be in the bulk package.

The rotating pick-up arms 134 bring the post member 148 retained by vacuum cups 140 to a second position spaced from both the magazine structure and the objects 12 in the partially assembled bulk package. Located at said second location is means for placing the removed post member into engagement with objects located at one of the corners of the bulk package. More specifically, such means for placing the removed post member into engagement with objects located at one of the corners comprises a transport element 150.

The construction and operation of the transport element 150 of each post member positioning device 114 is best illustrated in FIGS. 4 and 5. In actual operation, all of the post member positioning devices function in substantial unison and the transport elements 150 thereof also perform their appointed tasks at generally the same time. However, to more clearly disclose the transport element, FIGS. 3 and 4 illustrate the transport elements on the right-hand side of those figures at one stage of their operation while the transport elements 114 on the left-hand sides of FIGS. 3 and 4 are illustrated in a subsequent stage of their operation.

Quite simply, it is the task of each transport element 150 to receive a post member from its associated pick-up element 132, orient the post member in a vertical orientation and place the vertical post member into engagement with paper towel packages or other objects 12 of the bulk package at the corners of the bulk package.

Each transport element 150 includes a primary transport arm 152 and an auxiliary transport arm 154. Primary transport arm 150 is pivotally mounted about pivot 156 and air cylinder 158 selectively moves the primary transport arm 152 from the horizontal position illustrated on the right-hand side of FIG. 3 to the vertical position illustrated on the left-hand side of FIG. 3.

The auxiliary transport ar 154 is pivotally attached as by means of hinge 160 to the distal end of primary transport arm 152. The distal end of auxiliary transport arm 154 includes a cradle element 162, the cradle element including interconnected diverging sides generally corresponding to the configuration of the V-shaped cross section of the post members.

During the initial stage of operation of transport element 150, the auxiliary transport arm is also disposed generally horizontally. The relationship between the pick-up element 132 and the transport element 150 is such that when the pick-up arm 134 rotate from the aforesaid first position to the second position the pick-up arms and vacuum cup assemblies swing down past and clear the ends of auxiliary transport arm cradle element 162 as perhaps best seen in FIGS. 3 and 4. This movement causes the post member supported by the vacuum cup assemblies 136 to lodge in cradle 162. Suitable switching mechanism turns off the vacuum to vacuum cups 140 and applies a vacuum to vacuum cups 164 operatively associated with the cradle element 162. Thus, the post member 48 is secured into position relative to the cradle element 162 by the vacuum.

After this transfer has been accomplished, the primary transport arm and auxiliary transport arm are raised to their respective vertical positions illustrated on the left-hand side of FIG. 3 by their operatively associated air cylinder 158.

Referring now to FIG. 4, the left-hand side of that figure illustrates the positions assumed by the two adjacent transport elements 150 after the primary transport arm has been raised to a vertical orientation. It will be seen that the distal end of the auxiliary transport arm 154 is initially spaced from the adjacent bulk package corner. That is, the auxiliary transport arm 154 occupies the solid line position illustrated at the left-hand side of FIG. 4.

A second prime mover means in the form of an air cylinder 168 is actuated and the auxiliary transport arm 154 pivots to the dash line position. In the dash line position the distal end of the auxiliary transport ar urges the post member 48 carried by the cradle element 162 thereof against individual packages or objects 12 disposed at the adjacent bulk package corner. The auxiliary transport arms 154 of all of the post member positioning devices 114 maintain the post members 48 in engagement with the corner packages during the next step in the assembly of the completed bulk package which will now be described.

While the post members 48 are being held at the corners of the partially completed bulk package 10, a mechanism which will now be described operates to fold the tray flaps of the bottom tray and fold the cap flaps of the top cap so that such flaps occupy the positions shown in FIG. 1. It will be noted that in the assembled bulk package 10, the tray flaps are disposed over the lower ends of the post members 48 and such lower ends are frictionally engaged between adjacent tray flaps and the bottom tier of individual packages 12. Similarly, the upper ends of post members 48 are sandwiched between and frictionally engaged by adjacent cap flaps and the upper package tier or layer.

Referring now to FIG. 2, mounted for movement relative to framework 52 above partially assembled bulk package 10, when the bulk package is centrally located between the post member positioning devices 114, is a movable frame 170 which is selectively moved up and down by a hydraulic cylinder device 172. Mounted on frame 170 and movable therewith are a plurality of spacer pad magazines which comprise spaced sidewalls 176 defining a guide-way for a stack of spacer pads 50. It will be appreciated that the magazines 174 correspond in number to the spacer pads 50 being applied to the cap panel 34 and that the magazines 174 are located directly over the predetermined areas 98 of adhesive previously sprayed onto the cap panel by spray nozzles 92.

Hingedly mounted on the outer-most side walls 176, i.e. the side walls generally in registry with the side walls of the bulk package 10, are cap flap engaging plates. The cap flap engaging plates are illustrated somewhat diagrammatically in FIG. 6. The cap flap engaging plates are identified by reference numerals 180, 182, 184, and 186. In the interest of simplicity, only two such cap flap engaging plates, plates 180, 184, are shown in FIG. 2. It will be noted with reference to FIG. 6 that cap flap engaging plates 180, 184 each include a central cap plate segment 190 and end cap plate segments 192 hingedly connected to the ends of, and movable relative to, the respective central cap plate segments. Hydraulic cylinders 194 are disposed between each cap flap engaging plate and a spacer pad magazine side wall and, when actuated, move the associated cap flap engaging plates from a general horizontal disposition to a vertical one. This movement is illustrated and denoted by arrows in FIG. 2.

The hydraulic cylinder device 172 lowers the frame and all of the equipment depending therefrom down and into close proximity with top cap 32. At this point, the hydraulic cylinders 194 are actuated and the cap flap engaging plates pivotally moved down into a general vertical orientation. This serves to fold all of the cap flaps approximately 90 degrees relative to the cap panel 34. After this has been accomplished, air cylinders 196 disposed between central can plate segments 190 and their respective end cap plate segments 192 are actuated to fold the end cap flap portions 46 and place these portions into engagement with an adjacent cap flap. It will be appreciated that adhesive predetermined portions 96 are disposed between the end cap flap portions and the adjacent cap flap whereby these components will be secured together.

FIG. 6A shows a similar arrangement for folding the tray flaps. The tray flap manipulating means, in the interest of simplicity, has not been shown in FIG. 2, but it is to be understood that the tray flap manipulating means illustrated diagrammatically in FIG. 6A is located in the vicinity of belt conveyer 90.

The tray flap manipulating means includes a plurality of tray flap engaging plates 202, 204, 206 and 208 to engage tray flaps 18, 20, 22 and 24. A hydraulic cylinder 212 is associated with each tray flap engaging plate and adapted to push the tray flap engaging plate to an upright, generally vertical position. This action obviously also bends the tray flaps upwardly so that they are at right angles to the tray panel. Plates 202 and 206 each include a central tray plate segment 214 and end tray plate segments 216 hingedly connected to the ends of the central tray plate segment. Air cylinders 218 are associated with the segments 214 and 216 to move the end tray plate segments at right angles relative to the central tray plate segments. This operation brings the end tray flap portions 28 into engagement with an adjacent tray flap. The adhesive previously applied to predetermined portions 94 on the end tray flap portions 28 will be disposed between the end tray flap portions and the adjacent tray flap with which they are in partial registry. This will serve to maintain the lower ends of the post members 48 at their respective corners due to frictional engagement between the post members, objects 12, and the tray flaps.

Referring once again to spacer pad magazines 174, FIGS. 5 and 5A illustrate diagrammatically how spacer pads are applied to cap panel 34 when frame 170 is lowered relative to the partially completed bulk package 10. The lower ends of spacer pad magazine side walls 76 approach but do not actually engage cap panel 34. The side walls 76 are in fact spaced from the cap panel 34 a distance slightly exceeding the thickness of a spacer pad 50.

The stack of spacer pads 50 in each of the spacer pad magazines 174 are freely slideably movable therein but are prevented from falling out of the open bottom of the magazine by virtue of the fact that the lower-most spacer pad 50 is frictionally engaged between one of the side walls 176 and the movable element of an air cylinder device 222. When the movable element is retracted, the lower-most pad will fall to the position illustrated in FIG. 5A. That is, the lower-most spacer pad in the stack will engage the cap panel 34 at a predetermined area 98 to which adhesive has previously been applied. This adhesive will cause the pad to adhere to the cap panel. When this has been accomplished, the air cylinder device 222 is again actuated to clamp in place the spacer pad 50 resting upon the spacer pad applied to the cap panel.

After a predetermined period of time sufficient for the adhesive to bond the cap and tray flaps has passed, the top cap and tray flap engaging plates are returned to their respective initial positions and the hydraulic cylinder device 172 is actuated to move frame 170 upwardly. The spacer pads 50 in the magazines 174 will not fall out of the bottoms thereof because of the action of air cylinder devices 222.

The bulk package 10 is now completely assembled. Conveyer 90 is again actuated to move the bulk package 10 to a desired downstream location. Preferably, the bulk package 10 is covered with an outer wrap such as plastic film. Such expedient is well known, forms no part of the present invention, and is not illustrated.

One of the useful features of the preferred embodiment of apparatus constructed in accordance with the teachings of the present invention is its ability to form bulk packages of different sizes. For example, the dual magazine arrangement for the post members already described allows the apparatus to form bulk packages of differing heights and tier numbers. Further adding to the versatility of the apparatus is the fact that the post member positioning devices 114 may be moved relative to one another so that they will still operate to apply post members 48 to the bulk package corners regardless of the outer bulk package size.

FIG. 7 illustrates diagrammatically the fact that each post member positioning device 114 may be moved selectively in either one of two directions, that is, either parallel to the run of conveyer 90 or at right angles thereto. As perhaps best illustrated in FIG. 4, each post member positioning device 114 is mounted on two relatively movable mounting plates 230, 232. Manually actuatable screw devices 234 and 236 provide for adjustment of the plates. It will be appreciated that rotation of screw devices 234 will move both mounting plates 230, 232 in a direction parallel to belts 102, 104 of conveyer 90. On the other hand, rotation of screw devices 236 will move mounting plates 232 relative to mounting plates 230 either toward or away from the conveyer 90. To facilitate such movement, a simple track and wheel arrangement may be employed both between the mounting plates 230, 232 and between the mounting plate 230 and the floor supporting the apparatus. FIG. 8 illustrates a portion of such an arrangement.

We claim:

1. Apparatus for forming a bulk package, said bulk package including objects stacked in layers with each layer comprising a plurality of said objects disposed in rows, a bottom tray disposed under the lower-most layer, a top cap disposed over the upper-most layer, and a plurality of elongated post members extending between the bottom tray and the top cap, said apparatus comprising, in combination:

bottom tray placement means for placing the bottom tray on a support;

stacking means for stacking said layers of objects on said bottom tray after placement of said bottom tray on said support;

top cap positioning means for positioning said top cap over the upper-most layer of objects after said stacking means has stacked said layers of objects; and post member positioning means for positioning post members at preselected spaced locations between said bottom tray and top cap.

2. The apparatus according to claim 1 wherein said bottom tray includes a tray panel and tray flaps disposed at least partially about the periphery of said tray panel, said apparatus additionally comprising tray flap manipulating means for engaging said tray flaps, folding said tray flaps relative to said tray panel, and bringing said tray flaps into engagement with said post members.

3. The apparatus according to claim 2 additionally comprising adhesive applicator means for applying adhesive to at least some of said tray flaps at predetermined portions thereof, said tray flap manipulating means operable during folding of said trap flaps to bring adjacent tray flaps together at said tray flap predetermined portions to secure said adjacent tray flaps together with said adhesive and maintain said post members at said preselected locations with said post members disposed between tray flaps and said objects.

4. The apparatus according to claim 3 wherein said top cap includes a cap panel and cap flaps disposed at least partially about the periphery of said cap panel, said apparatus additionally comprising cap flap manipulating mean for engaging said cap flaps, folding said cap flaps relative to said cap panel, and bringing said cap flaps into engagement with said post members.

5. The apparatus according to claim 4 wherein said adhesive applicator means is adapted to apply adhesive to at least some of said cap flaps at predetermined portions thereof, said cap flap manipulating means operable during folding of said cap flaps to bring adjacent tray flaps together at said cap flap predetermined portions to secure said cap flaps together with said adhesive and maintain said post members at said predetermined locations with said post members disposed between tray flaps and said objects.

6. The apparatus according to claim 4 additionally comprising spacer pad placement means for placing a plurality of spacer pads on said cap panel, said adhesive applicator means, prior to placement of said spacer pads on said cap panel, adapted to apply adhesive to said cap panel at predetermined areas of said cap panel to secure said spacer pads to said cap panel.

7. The apparatus according to claim 1 wherein said bulk package defines a plurality of sides intersecting at corners, said preselected locations being at said corners and said post member positioning means comprising a plurality of post member positioning devices, each such post member positioning device adapted to position a post member at one of said corners.

8. The apparatus according to claim 7 wherein each said post member positioning device includes magazine structure adapted to hold a plurality of post members, means for removing a post member from said magazine structure, and means for placing the removed post member into engagement with objects located at one of said corners.

9. The apparatus according to claim 7 including means for varying the relative locations of said post member positioning devices.

10. The apparatus according to claim 8 wherein said means for removing said removed post member includes a pick-up element movable between a first position whereat the pick-up element engages the post member at said magazine structure and a second position spaced from both said magazine structure and said objects.

11. The apparatus according to claim 10 wherein said means for placing said removed post member into engagement with objects located at one of said corners includes a transport element for transporting said removed post member from said second position to objects at said one corner.

12. The apparatus according to claim 10 wherein said pick-up element comprises a pivoted pick-up arm and a vacuum cup assembly on said pick-up arm, said vacuum cup assembly including at least one vacuum cup for engaging said post member at said magazine structure and applying a vacuum to said post member to retain said post member on said pick-up element during movement of said pick-up element between said first and second positions.

13. The apparatus according to claim 12 wherein said vacuum cup assembly includes a vacuum cup support arm pivotally connected to said pick-up arm, said vacuum cup support arm supporting a plurality of said vacuum cups in spaced relationship.

14. The apparatus according the claim 11 wherein said transport element includes a primary transport arm, an auxiliary transport arm movably mounted on said primary transport arm, first prime mover means for selectively moving said primary transport arm, and second prime mover means for selectively moving said auxiliary transport arm relative to said primary transport arm, said primary transport arm being movable by said first prime mover means in a generally vertical plane from a generally horizontal position to a generally vertical position, and said auxiliary transport arm being movable by said second prime mover means in a generally horizontal plane when said primary arm is in said generally vertical position.

15. The apparatus according to claim 14 wherein said auxiliary transport arm includes a cradle element at the distal end thereof, said post members having a V-shaped cross-section and said cradle element including interconnected diverging sides generally corresponding to the configuration of said V-shaped cross-section.

16. The apparatus according to claim 4 wherein said cap flap manipulating means comprises a first opposed pair of movable cap flap engaging plates and a second opposed pair of movable cap flap engaging plates, at least some of said cap flaps including a central cap flap portion and end cap flap portions hingedly connected to opposed ends of said central cap flap portion, said cap flap engaging plates of at least one of said pairs of movable cap flap engaging plates including a central cap plate segment for engaging and folding a central cap flap portion and end cap plate segments connected to the ends of and movable relative to said central cap plate segment to bend said end cap flap portions and place said end cap flap portions in face-to-face engagement with an adjacent cap flap.

17. The apparatus according to claim 2 wherein said tray flap manipulating means comprises a first opposed pair of movable tray flap engaging plates and a second opposed pair of movable tray flap engaging plates, at least some of said tray flaps including a central tray flap portion and end tray flap portions hingedly connected to opposed ends of said central tray flap portion, said tray flap engaging plates of at least one of said pairs of movable tray flap engaging plates including a central tray plate segment for engaging and folding a central tray flap portion and end tray plate segments connected to the ends of and movable relative to said central tray plate segment to bend said end tray flap portions and place said end tray flap portions in face-to-face engagement with an adjacent tray flap.

18. The apparatus according to claim 5 wherein said adhesive applicator means comprises a plurality of spray nozzles disposed in tiers for applying adhesive to said tray flap predetermined portions and said cap flap predetermined portions.

19. The apparatus according to claim 8 wherein each said magazine structure includes a plurality of magazines, said magazines adapted to hold post members of differing predetermined lengths, said post member removing means adapted to selectively remove post members from any one of said magazines.

20. Apparatus for forming a bulk package having a plurality of sides intersecting at corners, said bulk package including objects stacked in layers with each layer comprising a plurality of objects disposed in rows, a bottom tray disposed under the lower-most layer, said bottom tray including a tray panel and tray flaps disposed at least partially about the periphery of said tray panel, a top cap disposed over the uppermost layer, said tray cap including a cap panel and cap flaps disposed at least partially about the periphery of said cap panel, and elongated post members located at said corners and extending between the bottom tray and top cap, each said post member being maintained at one of said corners by frictional engagement between said objects and said tray and cap flaps, said apparatus comprising, in combination:

bottom tray placement means for placing the bottom tray on a support;

stacking means for stacking said layers of objects on said bottom tray after placement of said bottom tray on said support;

top cap positioning means for positioning said top cap over the upper-most layer of objects after said stacking means has stacked said layers of objects;

post member positioning means for positioning said post members at said corners;

tray flap manipulating means for folding said tray flaps and bringing said tray flaps into engagement with said post members whereby the lower ends of said post members are maintained between the tray flaps and objects at said corners; and cap flap manipulating means for folding said cap flaps and bringing said cap flaps into engagement with said post members whereby the upper ends of said post members are maintained between the cap flaps and objects at said corners.

* * * * *